US005709611A

United States Patent [19]

Intag

[11] Patent Number: 5,709,611

[45] Date of Patent: Jan. 20, 1998

[54] GOLF CLUB ALIGNMENT DEVICE

[76] Inventor: Dominic T. Intag, 4811 S. Lindbergh Blvd., St. Louis, Mo. 63126

[21] Appl. No.: 813,447

[22] Filed: Mar. 10, 1997

Related U.S. Application Data

[60] Provisional application No. 60/016,600 May 8, 1996.

[51] Int. Cl.[6] ..... A63B 69/36

[52] U.S. Cl. ..... 473/236; 473/244; 473/251

[58] Field of Search ..... 473/236, 244, 473/251

[56] References Cited

U.S. PATENT DOCUMENTS

| | | | |
|---|---|---|---|
| 976,176 | 11/1910 | Holllingsworth | 473/236 X |
| 3,194,564 | 7/1965 | Swan | 473/236 |
| 3,384,376 | 5/1968 | Greenlee . | |
| 3,730,529 | 5/1973 | Donofrio | 473/236 X |
| 4,988,107 | 1/1991 | Sasse . | |
| 5,135,229 | 8/1992 | Archer | 473/236 |
| 5,219,169 | 6/1993 | Martini . | |
| 5,417,429 | 5/1995 | Strand . | |
| 5,429,366 | 7/1995 | McCabe . | |
| 5,441,273 | 8/1995 | Stormon . | |
| 5,447,313 | 9/1995 | Finley . | |

*Primary Examiner*—George J. Marlo
*Attorney, Agent, or Firm*—Kevin L. Klug

[57] ABSTRACT

A retractable golf club alignment device and method for use for assisting a golfer to hit the sweet spot of a golf ball with the optimum spot on the face of a golf club head. The device comprise a retractable extension pin mounted through the optimum spot on the club face which extends from the face of the golf club head and provides a three dimensional alignment aid to the golfer and retracts flush with the golf club face when the golfer hits a golf ball. The retractable extension pin is mounted in a pin bearing and extended via a pin extender unit. In use, the golfer mentally notes the position and extension axis of the extension pin and then proceeds with a normal swing as if the extension pin was not present. The extension pin does not affect the expected trajectory of the golf ball.

7 Claims, 3 Drawing Sheets

GOLF CLUB ALIGNMENT DEVICE

I hereby claim the benefit of Provisional Application 60/016,600, filed May 8, 1996.

BACKGROUND OF THE INVENTION

The present invention relates in general to devices and methods which help a person align, contact and propel a golf ball in a desired direction when playing golf. It pertains, more particularly, to a device which fits on the head of a golf club and assists a golfer to locate and contact the "sweet spot" of the golf ball with the optimum contacting spot on the club head and at the proper head angle.

It has long been recognized that a golf club should meet a golf ball at a ball's tangential point defined by the initial straight directional line of trajectory which intersects the ball center and the tangential point where the ball is hit. Within the art, this tangential point is commonly called the "sweet spot" of the golf ball. It is the point that when properly aligned and hit with the club head, the golf ball will fly with a predictable and desired trajectory.

Although the prior art is replete with conventional devices which act as golf aiming aids, none of the prior art devices provide a method or device for providing optimum contact with the "sweet spot" of a golf ball while not affecting the golf club swinging characteristics or its effect on the ball velocity, spin or trajectory. The prior art devices also lack a convenient and unobtrusive method for assisting the golfer in maintaining a perpendicular head position with the golf ball, all within a device which is usable during practice or conventional play and during driving or putting.

It is thereby an objective of the present invention to provide an apparatus and method for assisting a golfer to hit the sweet spot of a golf ball with a golf club by providing a device which mounts within the head of a golf club.

Another object of the present invention is to provide a device which is mounted into the head of a conventional golf club without affecting the swing characteristics of the club, adversely affecting its weight, or significantly altering the velocity or trajectory of the ball relative to a conventional club head.

A further object of the present invention is to provide a device which may be installed on an existing and conventional golf club head with a minimum amount of modification.

A still further object of the present invention is to provide a device which is securely mounted onto a golf club head and able to withstand the forces due to ball impact.

A still further object of the present invention is to provide for the automatic retraction of the aiming portion of the device when contacting a golf ball.

SUMMARY OF THE INVENTION

To accomplish the foregoing and other objects of this invention there is provided a retractable golf club alignment device which mounts into and through a conventional golf club head and acts as an aiming aid for the golfer. The device provides an extension pin which is used to align the optimum portion of the golf club head with the "sweet spot" on the golf ball. Upon impact with the ball, the pin retracts thereby minimizing interference with the flight characteristics of the ball itself.

The pin is mounted within the head of the club, extends outwardly from the ball contacting portion of the head, and is free floating. The force required to retract the pin is so very small that it will have negligible effect upon the ball when the club is used in the normal course of practice or during a game. Upon retraction into the head, the pin provides for a flush mount with the head face. That is, it preserves the original shape of the club head into which it is installed when it retracts. This ensures that the flight characteristics of the ball attributable to the club head shape are equivalent to those characteristics created by a club head without the retractable golf club alignment device installed.

The pin is extended outwardly from the club head by pushing a spring loaded pin extender cap which is located on the opposite side of the head from the point of extension of the pin. The spring loading of the pin extender cap causes it to retract. This retraction assures that the extension pin is free floating and easily retracts when contacted with a golf ball. Although the extension pin is caused to retract by the force of the golf ball upon it, an alternative embodiment could cause retraction by means of a pin spring which retracts the extension pin when the extension pin is touched by a golf ball.

Before driving or putting a golf ball, the golfer extends the extension pin by pushing and releasing the pin extender cap. The golfer uses the extension pin to align the optimum portion of the club head, which is collocated with the center of the extension pin, with the sweet spot of the golf ball. This alignment provides a mental visual image of where the sweet spot of the ball is and how the golf head must be aligned to obtain proper positioning. The extension of the pin also helps to insure that the golfer is aligning the club head face with the proper angle relative to the ball. That is, the pin extension will optimally be parallel with the plane of swing. Upon achievement of the proper mental image, the golfer focuses his or her attention upon the ball and proceeds with a swing or put. The mental image created by the extension pin helps to insure that the swing or put has the optimum alignment with the ball sweet spot.

The present invention can be manufactured of different materials, sizes and colors. In one preferred embodiment, the extension pin is manufactured of a steel material which is mounted within a brass or bronze bushing.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
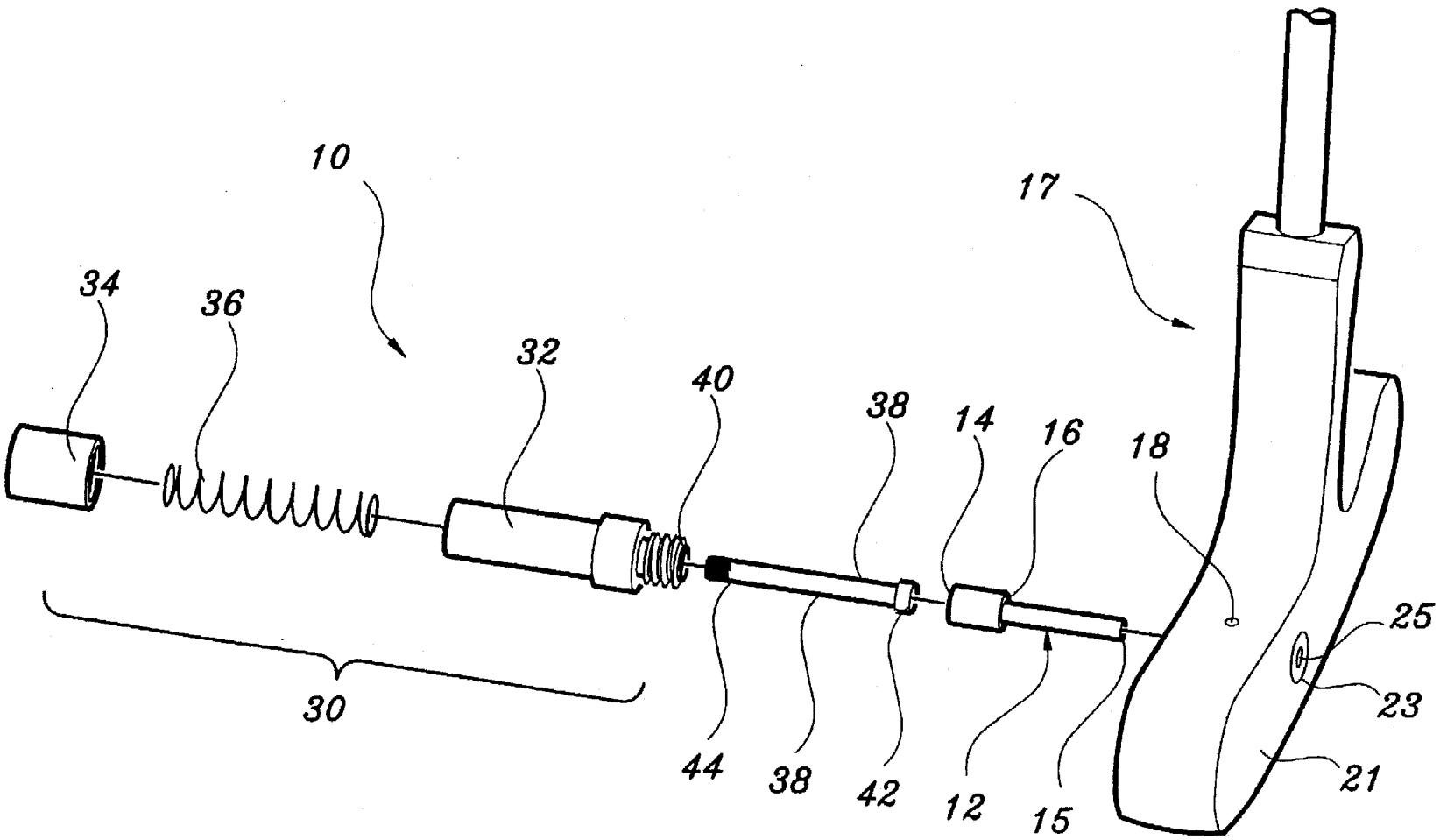
FIG. 1 is a phantom exploded perspective view of the preferred embodiment of the retractable golf club alignment device and its mounting within a golf club head.
Figure 2:
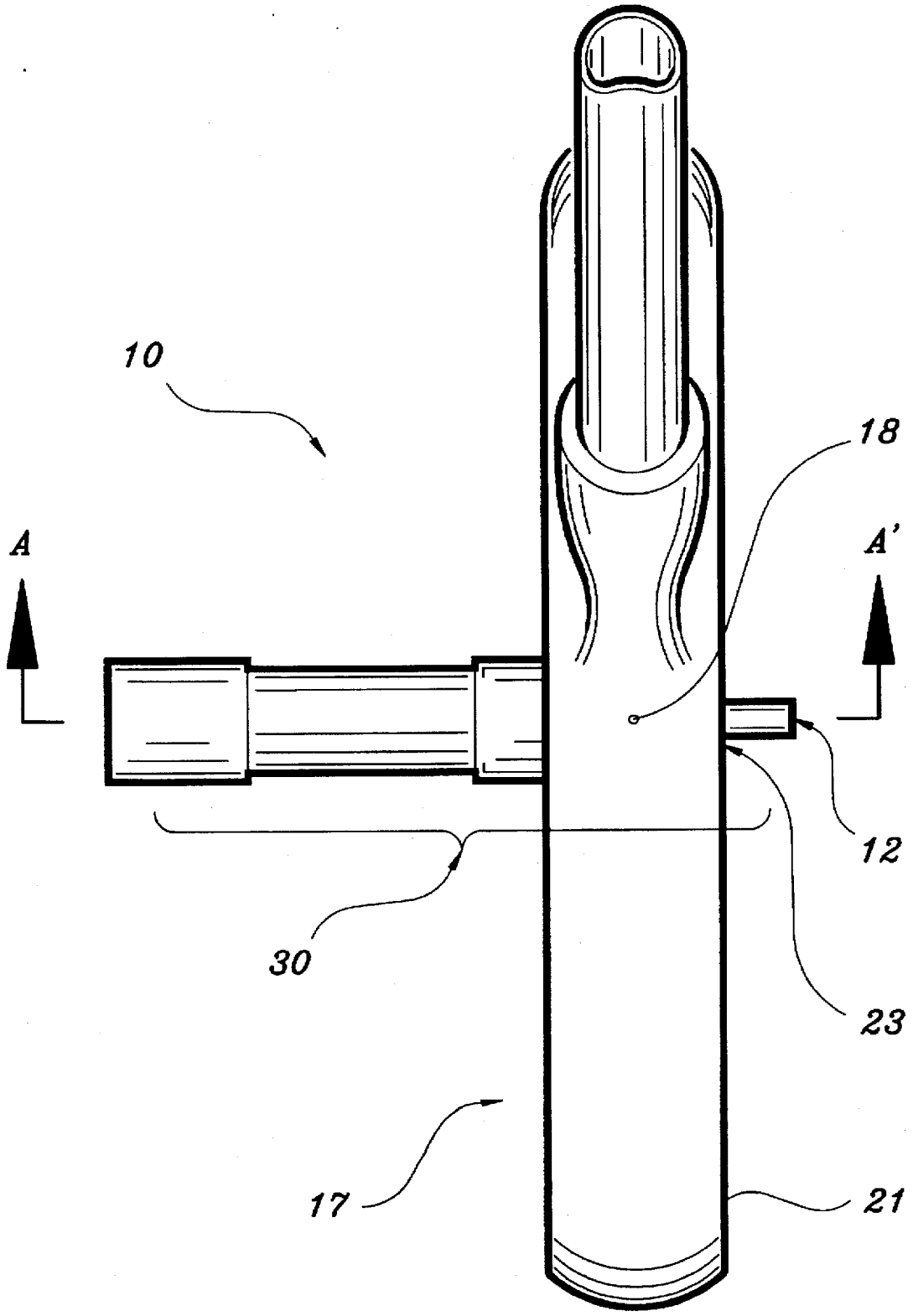
FIG. 2 is a top plan view of the preferred embodiment of the retractable golf club alignment device mounted within a golf club head.
Figure 3:
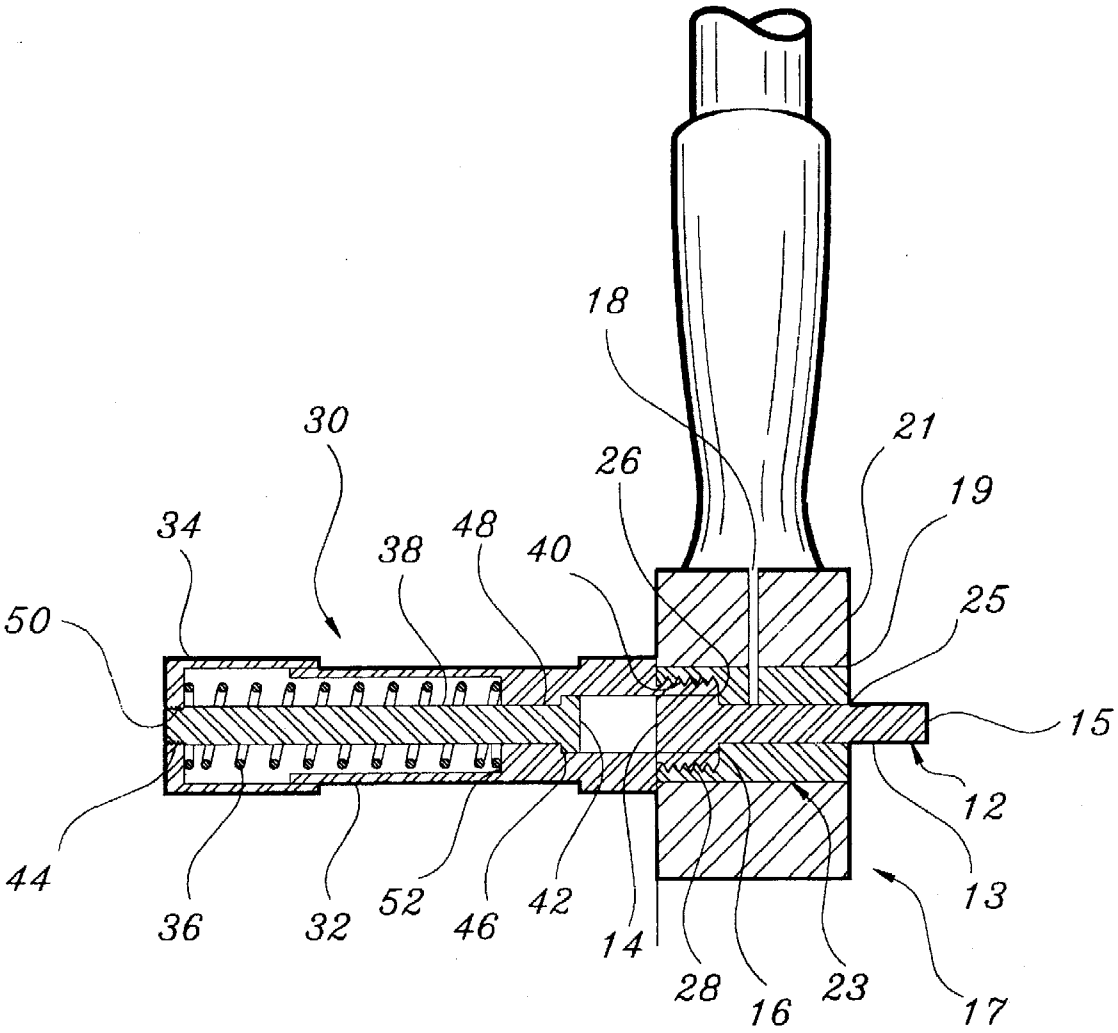
FIG. 3 is a cross section side view taken along line A–A'of FIG. 2 of the preferred embodiment of the retractable golf club alignment device mounted within a golf club head.

Referring now to the drawings, there is shown a preferred embodiment in FIGS. 1–3 of the retractable golf club alignment device. The retractable golf club alignment device and the method of using such is described in conjunction with a golf club head, golf ball, and golfer.

In a preferred embodiment, the retractable golf club alignment device 10 is comprised of an extension pin 12 formed from a substantially cylindrically shaped shaft 13, a pin head 14 of moderately larger diameter than the cylindrically shaped shaft 13, and a contacting portion 15. The extension pin 12 fits within a conventional golf club head 17 after a hole 19 has been bored through the head and a pin bearing 23 frictionally inserted within the hole. In the preferred embodiment, the pin bearing 19 is press fitted within the hole 19 and contains a bearing hole 25 through which the extension pin 12 is inserted. The diameter of the bearing hole 25 is only slightly larger than the diameter of the extension pin shaft 13 thereby providing optimum guidance of the extension pin 12 while also allowing for natural lubrication. In a preferred embodiment, the pin bearing 19 is of a bronze or brass material, but may be manufactured of any material which limits the possibility of the extension pin 12 seizing. The preferred embodiment also incorporates a small oil lubricating hole 18 through the golf club head 17, the pin bearing 23 and into the bearing hole 25 through which a light lubricating oil may be provided to the extension pin 12.

The hole 19 within the head 17 along with the pin bearing 23 is aligned parallel with the optimum direction of travel of the conventional golf club head 17. Furthermore, the center of the hole 19, which is collocated with the center of the bearing hole 25, also intersects the optimum spot on the golf club face 21 where a golf ball should be hit. This spot is typically called the "sweet spot" of the club head 17.

Opposite the golf club face 21, the bearing hole 25 is counterbored to a diameter and depth such that the pin head 14 of the extension pin 12 may freely fit within the conventional golf club head 17. The pin head 14 forms a pin shoulder 16 where the pin head 14 interconnects with the shaft 13. This pin shoulder limits the extension of the extension pin 12. The extension pin 12 is limited by the seating of the pin shoulder 16 upon the seat 26 created by the counterboring of the bearing hole 25. The extension of the contacting portion 15 of the extension pin 12 beyond the club face 21 of the head 17 is optimumly extended when it achieves a length which is most comfortable for the golfer. It should be noted that an alternative embodiment could incorporate an adjustment means by which the golfer may adjust the extension of the contacting portion 15 while on the golf course.

In the preferred embodiment, the counterbored portion of the bearing hole 25 contains extender unit threads 28 into which a pin extender unit 30 is mounted. The pin extender unit 30 is a spring loaded device which is used to extend the extension pin 12 prior to use by pressing upon the pin head 14 and thereby causing the contacting portion 15 of the extension pin 12 to optimally extend beyond the club face 21. In a preferred embodiment, the pin extender unit 30 is comprised of four component parts: an extender unit housing 32, a pin extender cap 34, an extender spring 36, and a pusher rod 38.

The extender unit housing 32 is a tubular member which contains the housing threads 40 which intermesh with the extender unit threads 28 when mounted onto the club head 17. The extender unit housing 32 contains a reduced diameter portion 48 which forms an internal first housing shoulder 46 upon which the pusher rod 38 seats when the pin extender unit 30 is assembled and the extender spring 36 is compressed. The extender spring 36 seats upon the second housing shoulder 52 and the pin extender cap 34 in order to place tension upon the pusher rod 38 and ensure that it seats with the first housing shoulder 46.

The pusher rod 38 fits through the end portion of the extender unit housing 32 containing the housing threads 40. The pusher rod 38 is a substantially cylindrical member which is comprised of two ends. The first end contains a pusher head 42 which has a larger cylindrical diameter than the rest of the pusher rod 38. The second end contains a small portion of pusher threads 44 which engage the cap threads 50 of the pin extender cap 34 to hold the pin extender unit 30 together when assembled.

The pin extender unit 30 is assembled by first placing the pusher rod 38, pusher threads 44 first, into and through the extender unit housing 32 from the housing threads 40 end and seating it upon the first housing shoulder 46. The extender spring 36 is then inserted into the opposite end of the extender unit housing 32 and seated upon the second housing shoulder 52. When seated, the pin extender cap 34 is placed over the extender unit housing 32, opposite the housing threads 40, thereby compressing the extender spring 36. The cap threads 50 of the pin extender cap 34 are engaged with the pusher threads 44 of the pusher rod 38, thereby causing the extender spring 36 to remain in compression when the pin extender unit 30 is assembled.

Upon assembly of the pin extender unit 30, the extension pin 12 is inserted through the extender unit threads 28 of the pin bearing 23, contacting portion 15 first, and into the bearing hole 25. Thereafter, the pin extender unit 30 is integrally connected with the conventional golf club head 17 by engaging the extender unit threads 28 of the head 17. When the pin extender cap 34 is depressed, the pusher rod 38 is caused to contact the pin head 14 of the extension pin 12 and thereby force the contacting portion 15 out of the club face 21 to its optimum extension. That is, the extension pin shoulder 16 seats upon the pin bearing seat 26 thereby limiting the extension of the extension pin 12. Upon release of the pin extender cap 34, the pusher rod 38 retracts into the extender unit housing 32 and seats upon the first housing shoulder 46, thus allowing the the extension pin 12 to float freely. It is important to note that the frictional contact between the extension pin 12 and the bearing hole 25 is such that the extension pin 12 does not retract when the club head 17 swings but only upon contact with a golf ball.

It should be noted that the pin extender unit 30 is not required in alternative embodiments. That is, if the extension pin 12 is free floating within the pin bearing 23, a golfer may simply tilt and shake the golf club head 17 in order to extend the extension pin 12. The retractable golf club alignment device 10 along with its alternative embodiments can be comprised of a variety of materials, including but not limited to, a metallic-type material, a polymer-type material, a wooden material or even a ceramic material although a metallic-type material is preferred.

In operation of the preferred embodiment, the golfer presses the pin extender cap 34 in order to extend the contacting portion 15 of the extension pin 12. Once extended, the golfer aligns the contacting portion 15 of the extension pin 12 with the sweet spot of the golf ball and insures that the pin axis is aligned with his or her direction of swing. Once aligned, the golfer can focus his or her attention upon the sweet spot of the golf ball and take a normal swing much like a carpenter focuses upon the nail and not the hammer when driving a nail. Upon contact with the ball, the extension pin 12 retracts flush with the club face 21, thereby creating a ball trajectory and velocity which is substantially similar to a golf club without the retractable golf club alignment device 10 installed. The extension pin 12 is held flush with the club face 21 upon retraction by the action of its pin head 14 contacting the pusher head 42 of the pusher rod 38. As previously noted, the pusher head 42 is seated upon the first housing shoulder 46 when the pin extender cap 34 is not depressed.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A retractable golf club alignment device for properly aligning a golf club head, said golf club head having a club face with a sweet spot and a hole through said club face and through said golf club head, with a golf ball comprising:

an extension pin of substantially cylindrical shape having a first end, a second end, and a shaft, said first end having a golf ball contacting portion and said second end having a pin head of moderately larger diameter than said shaft and connected via said shaft to said first end, said pin head forming a shoulder where it is connected with said shaft; and a pin bearing of substantially tubular shape adapted to be frictionally inserted within said hole of said golf club head, said pin bearing having a bearing hole of slightly larger diameter than said shaft of said extension pin, said bearing hole having a counterbored portion adapted to be opposite said club face and of larger diameter than said pin head which forms a seat; and said shaft of said extension pin floatingly held within said bearing hole whereby said golf ball contacting portion and a substantial portion of said shaft of said extension pin are protrudable from said club face and said extension pin is capable of substantially retracting when contacted with said golf ball thereby allowing said extension pin to be used as an aid when optimally aligning said golf club head and said golf ball; and said shoulder of said pin head optimally limiting the protrusion of said first end of said extension pin from said club face by contacting said seat when said first end of said extension pin is inserted into said bearing hole opposite said club face; and a pin extender unit having an extender unit housing, a pin extender cap, an extender spring, and a pusher rod;

said pusher rod having a first end and a second end connected via a substantially cylindrical member, said second end having a pusher head of moderately larger diameter than said substantially cylindrical member; and said extender unit housing being of substantially tubular form and having a first end, a second end, an inside, and an outside, said inside of greater diameter than said substantially cylindrical member of said pusher rod;

said inside of said first end of said extender unit housing having a counterbored portion with sufficient depth and sufficient diameter that a portion of said extender spring may fit within said inside of said first end, and said inside of said second end having a counterbored portion with a diameter at least as large as said pusher head of said second end of said pusher rod and with a depth such that said counterbored portion of said first end is not contacted with said counterbored portion of said second end; and said pin extender cap being of substantially cylindrical cup shape and having an interior, an exterior, an open end and a substantially closed end, said interior portion of said open end having a diameter at least as large as said outside of said extender unit housing of substantially tubular form; and said extender spring inserted into said inside of said first end of said extender unit housing and said interior of said open end of said pin extender cap inserted over said extender spring and said first end of said extender unit housing;

said first end of said pusher rod inserted into said inside and through said counterbored portion of said second end of said extender unit housing through said extender spring and rigidly attached to the interior portion of said substantially closed end of said pin extender cap, thereby comprising said extender spring and causing said pusher head of said second end of said pusher rod to fully retract within said counterbored portion of said second end of said extender unit housing; and said second end of said extender unit housing rigidly attached to said counterbored portion of said pin bearing and substantially centered and aligned with said bearing hole whereby said pin extender cap may be pushed to force said pusher head of said pusher rod to contact said pin head of said extension pin and thereby cause said contacting portion of said extension pin to extend from said club face.

2. A retractable golf club alignment device for properly aligning a golf club head with a golf ball as defined in claim 1 further comprising:

said depth of said counterbored portion of said second end of said extender unit housing defined such that said contacting portion of said extension pin retracts flush with said club face when said pin head of said extension pin contacts said pusher head of said pusher rod when said pin extender cap is not pushed.

3. A retractable golf club alignment device for properly aligning a golf club head with a golf ball as defined in claim 2, further comprising:

said pin bearing formed of a bearing material which prevents seizing of said extension pin.

4. A retractable golf club alignment device for properly aligning a golf club head with a golf ball as defined in claim 3 further comprising:

said second end of said extender unit housing rigidly attached to said pin bearing with housing threads formed onto said second end of said extender unit housing and extender unit threads formed into said counterbored portion of said pin bearing whereby the interconnecting of said housing threads and said extender unit threads rigidly attach said pin extender unit to said pin bearing; and said first end of said pusher rod rigidly attached to the interior portion of said substantially closed end of said pin extender cap with pusher threads formed onto said first end of said pusher rod and cap threads formed into said interior portion of said pin extender cap whereby the interconnecting of said pusher threads and said cap threads rigidly attach said pusher rod to said pin extender cap.

5. A retractable golf club alignment device for properly aligning a golf club head with a golf ball as defined in claim 4 further comprising:

said bearing hole adapted to be located at said sweet spot of said club face.

6. A retractable golf club alignment device for properly aligning a golf club head with a golf ball as defined in claim 5 wherein:

is adapted to be said bearing hole aligned parallel with an optimum direction of travel of said golf club head.

7. A retractable golf club alignment device for properly aligning a golf club head with a golf ball as defined in claim 8 further comprising:

an oil lubricating hole through said pin bearing and into said bearing hole whereby said extension pin may obtain oil lubrication.

* * * * *